United States Patent [19]

Jaggi

[11] Patent Number: 4,725,006

[45] Date of Patent: Feb. 16, 1988

[54] APPARATUS FOR CONVEYING SEWAGE

[75] Inventor: Hans Jaggi, Wolfhausen, Switzerland

[73] Assignee: Häny & Cie. AG, Meilen, Switzerland

[21] Appl. No.: 865,808

[22] Filed: May 22, 1986

[30] Foreign Application Priority Data

May 24, 1985 [CH] Switzerland ..... 02226/85

[51] Int. Cl.[4] ..... B02C 23/36

[52] U.S. Cl. ..... 241/46 B; 241/46.06; 241/46.11

[58] Field of Search ..... 241/46 R, 46 B, 46.06, 241/46.11, 46.17

[56] References Cited

U.S. PATENT DOCUMENTS

| | | | |
|---|---|---|---|
| Re. 29,626 | 5/1978 | Allen | 241/46.11 |
| 1,892,217 | 12/1932 | Moineau . | |
| 3,512,904 | 5/1970 | Allen . | |
| 3,667,692 | 6/1972 | Grace . | |
| 3,897,600 | 8/1975 | Burkholder | 4/10 |

FOREIGN PATENT DOCUMENTS

| | | |
|---|---|---|
| 1531005 | 5/1968 | France . |
| 2502260 | 9/1982 | France . |

OTHER PUBLICATIONS

"Die Pumpen", by Fuchslocher/Schulz, 11th edition, Springer-Verlag, pp. 283-285.

"Abwasserhebeanlagen" in the Fachzeitschrift fur Sanitur, Heizung, Klima, No. 23, vol. 35, 1st Edition, Dec. 1980, Berlin.

*Primary Examiner*—Timothy V. Eley

*Attorney, Agent, or Firm*—Fleit, Jacobson, Cohn & Price

[57] ABSTRACT

Apparatus for conveying sewage or waste water by means of a rotatable displacement pump positioned within a housing. A cutting device is positioned at a water inlet for cutting solid materials that are part of the waste water to reduce their size in order for the materials to be able to pass through the pump. The pump is an eccentric worm-gear pump and is driven by a motor drive shaft that also drives the rotatable portion of the cutting device. The apparatus has a compact design and provides a high suction capacity, and a conveying capability that is independent of the supply resistance, so that a small diameter pump outlet pipe can be provided for the sewage.

12 Claims, 2 Drawing Figures

APPARATUS FOR CONVEYING SEWAGE

BACKGROUND OF THE INVENTION

The present invention is directed to apparatus for the conveyance of waste water or sewage, and more particularly to sewage conveying apparatus including a rotary cutting device and a rotary pump carried on a common drive shaft.

It is a known method to use eccentric worm-gear pumps, which are among available rotating displacement pumps, for the conveyance of waste water or sewage. Eccentric worm-gear pumps have the advantage that the quantity of material they convey, when the speed of rotation of the rotary drive remains the same, is practically independent of the resistance in the delivery pipe, so that the latter can be dimensioned optimally for any desired use. Eccentric worm-gear pumps have the additional advantage that high pressures can be achieved. However, eccentric worm-gear pumps are not capable of handling large solids. For that reason, the suggestion has already been made to connect an eccentric worm-gear pump in series with a pulverizing device that reduces the size of materials drawn in by the eccentric worm-gear pump (see the paper by H. Putz entitled "Abwasserhebeanlagen" in the Fachzeitschrift fur Sanitur, Heizung, Klima, No. 23, volume 35, first edition, Dec. 1980, Berlin). The present invention has the objective of creating an apparatus of the type mentioned at the outset and is distinguished by a compact and simple design.

SUMMARY OF THE INVENTION

Briefly stated, in accordance with one aspect of the present invention, apparatus is provided for conveying sewage or waste water. The apparatus includes a housing having an inlet and an outlet for the sewage or waste water, and a rotating displacement pump is carried on the housing. Cutting means are positioned within the housing between the inlet and the outlet and upstream of the displacement pump in a sewage flow direction to cut and reduce the size of solid materials that are carried in the waste water. The displacement pump and the cutting means are connected by a common rotary drive shaft, and means are provided for rotating the common rotary drive shaft to simultaneously operate the pump and the cutting means.

The displacement pump is, by preference, an eccentric worm-gear pump, while in a preferred embodiment of the invention, the eccentric worm-gear pump and the cutting device are joined, on opposite ends of the common rotary drive, to said drive. On the other hand, it may also be advantageous to mount the cutting device between the eccentric worm-gear pump and the joint rotary drive.

DESCRIPTION OF THE PREFERRED EMBODIMENTS

Figure 1:
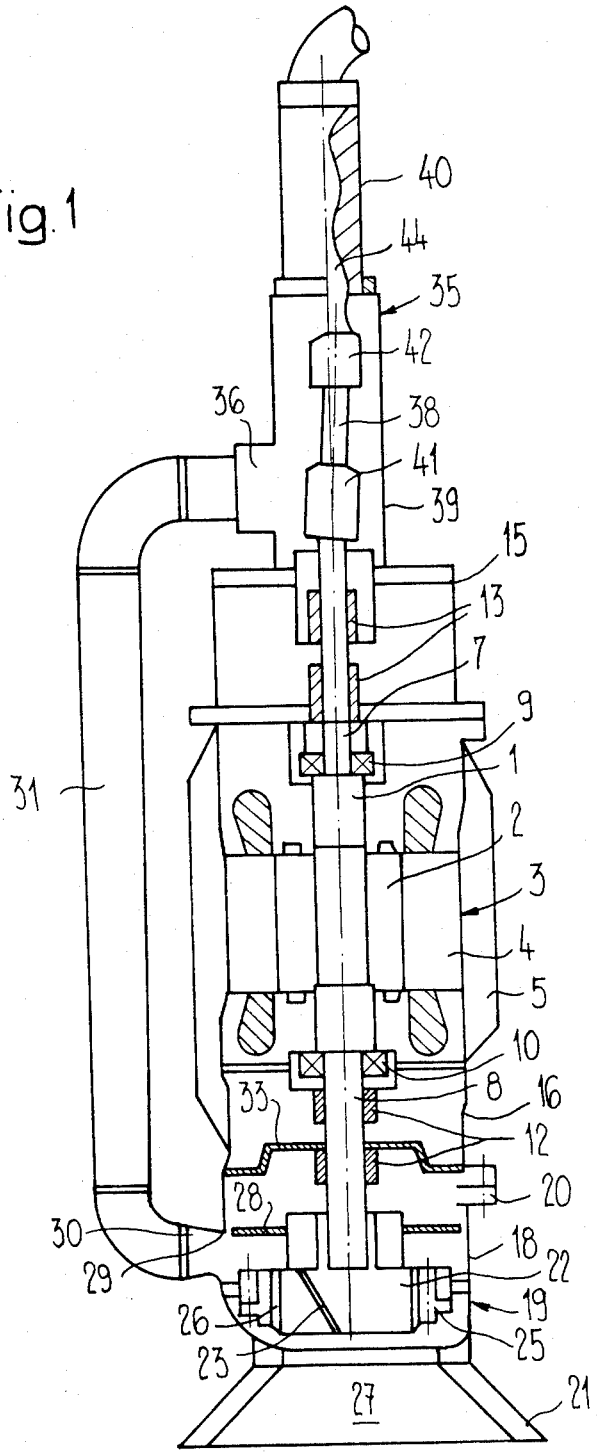
FIG. 1 is a side elevational view, partially in section, of sewage conveying apparatus in accordance with the present invention.

Referring now to the drawings, and particularly to FIG. 1 thereof, the structure shown is intended for vertical mounting in a sewage shaft, and in such a way that the axis of central transmission shaft 1, which supports the rotor 2 of an electric motor 3, extends vertically. The electric motor 3 has been designed as a submersible motor and is equipped with a cooling jacket 5 that surrounds the stator. The electric motor has two outwardly and oppositely extending shaft ends 7, 8 that extend through and are rotatably supported by respective bearings 9, 10, of the electric motor 3, as well as extending through one of outer housing parts 15, 16, each of which housing parts surrounds shaft packings 12, 13, respectively. Additional bearings may be enclosed by the outer housing parts of the casing.

The housing 18 of a cutting device 19 is mounted on the lower outer end housing 16 by way of a flanged joint 20. The lower part of housing 18 diverges outwardly and downwardly to enlarge into a funnel-shaped intake stack 21 which is mounted at a distance above the bottom of a sewage shaft (not shown). The cutting device 19 has a rotatable cutting head 22 that is mounted on the lower shaft end 8, and several cutting knives 23 are mounted on the periphery of the cutting head and at an angle to the longitudinal axis of the apparatus. The rotating cutting knives 23 effect the reduction of size or pulverization of solid components of the sewage in the course of interacting with a fixed counter-ring 25 that surrounds cutting head 22 and is mounted on housing 18 surrounding cutting device 19. The sewage flows through a gap 26 between the cutting head 22 and the cutting counter-ring 25, in which the cutting-up or tearing apart of the solid components, which can include, e.g., paper, textiles, and the like, takes place. On the side of the cutting head 22 that faces away from the intake opening 21, a rotatable water deflecting disc 28 is mounted and extends substantially across housing 18 and adjacent to the inner wall thereof. The outermost edge of disc 28 is substantially opposite the upper edge 29 of connecting member 30 for connection with a suction pipe 31, in order to deflect the sewage, after it has passed the cutting head 22, in the direction of the connecting member 30. A separation wall 33 for deflecting the sewage water is mounted above deflecting disc 28 within the lower end of housing 16 surrounding shaft end 8.

The eccentric worm-gear pump 35 is mounted on the upper end part of housing 15. The pump intake 36 of the pump 35 communicates with the cutting device 19 through the suction pipe 31, and is positioned to extend laterally outwardly from a housing part 39 that is axially positioned relative to and adjoins stator housing 40 of eccentric worm-gear pump 35. Housing 39 surrounds and encloses a coupling rod 38. The coupling rod 38 establishes, by way of two water-tightly encased universal joints 41, 42, the connection between the end of shaft 7 of the electric motor 3 and the helically twisted pump rotor 44, of which only a portion is shown in the drawing. As to the mode of operation of the eccentric worm-gear pump 35, reference is made to the technical literature, e.g., to the book entitled "Die Pumpen", by Fuchslocher/Schulz, eleventh edition, Springer Verlag.

Figure 2:
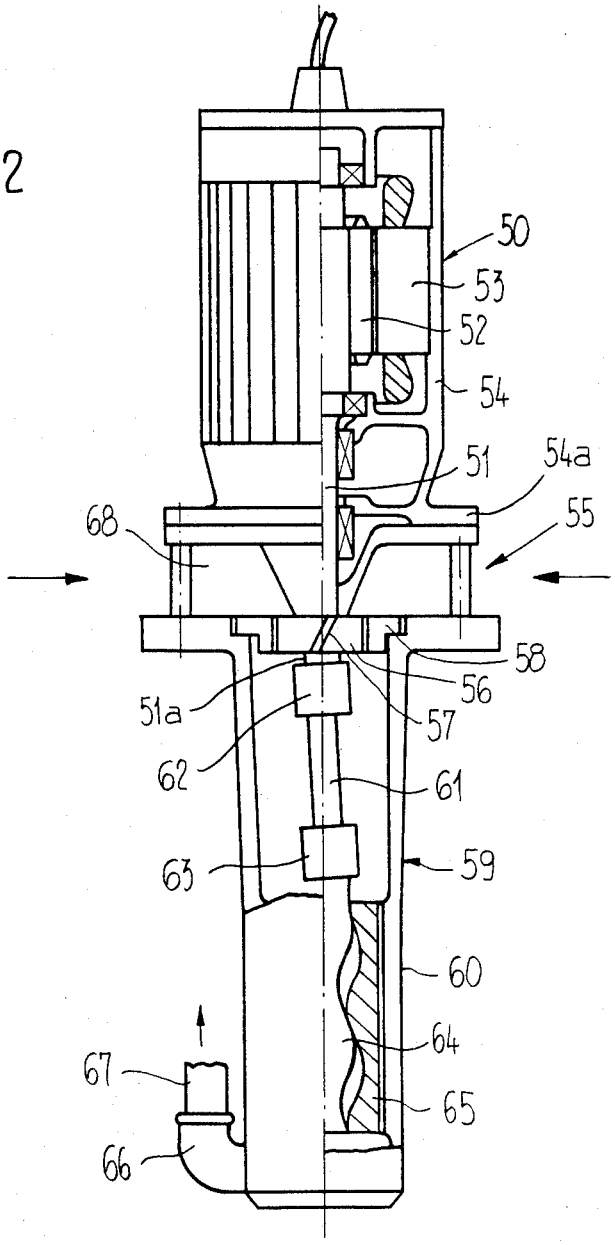
FIG. 2 is a side elevational view, partially in section, of another embodiment of sewage conveying apparatus in accordance with the present invention.

The embodiment of the apparatus for the conveyance of sewage as shown in FIG. 2, which is also positioned vertically, is very similar to the embodiment shown in FIG. 1 as to its assembly, but differs from it by the different arrangement of the cutting device and of the eccentric worm-gear pump. The electric motor 50 includes a rotor 52 that is mounted on a rotatable output shaft 51, and a stator 53 that is mounted on the inside of a casing 54. Casing 54 includes in its lower portion a coupling flange 54*a* on which a cutting device 55 is connected by means of a bolted connection. Cutting device 55 includes a rotatable cutting head 56 that is mounted on the shaft 51 of the electric motor 50. The periphery of the cutting head 56 supports several cutting knives 57 that cooperate with a fixed cutting counter-ring 58, that surrounds the cutting head 56, to reduce the size of solid components of the sewage. The cutting counter-ring 58 is supported at the inlet end of the housing 60 of an eccentric worm-gear pump 59. The housing 60 is also bolted to the coupling flange 54a of the driving motor 50. Inside the casing 60, a coupling rod 61 is positioned and is connected at one end thereof with the end 51*a* of the shaft 51 of the driving motor 50 by way of a water-tightly encased universal joint 62, and on the other end, the coupling rod 61 is connected with the helically twisted pump rotor 64 by way of a water-tightly encased universal joint 63. As was the case in FIG. 1, only a portion of pump rotor 64 is shown in FIG. 2. Pump rotor 64 interacts in a known manner with a stator 65 to provide a pumping effect. On its lower, or downstream end, housing 60 includes a connecting adapter 66 for engagement with a connecting pipe 67 on the pressure or outlet side of pump 59.

In operation, the sewage drawn into the apparatus by the eccentric worm-gear pump 59 flows, more or less radially, as shown by the arrows in FIG. 2, into an annular inflow chamber 68 situated above the cutting head 56, after which the sewage flows past the cutting head 56 and the cutting counter ring 58, so that the particle size of the solid materials is reduced, and is forced by the eccentric worm-gear pump 59 through the connecting adapter 66 and the connecting pipe 67.

It should be noted that both embodiments of the invention should have in common that the cutting head 22, 56, respectively, is mounted directly on the motor shaft 8 and 51, respectively, so that it always rotates about the axis of the motor shaft.

Although particular embodiments of the present invention have been illustrated and described, it will be apparent to those skilled in the art that various changes and modifications can be made without departing from the spirit of the present invention. It is therefore intended to cover in the appended claims all such changes and modifications that fall within the scope of the present invention.

What is claimed is:

1. Apparatus for conveying sewage, said apparatus comprising: an eccentric worm gear pump having a rigid stator and a pump rotor located within said rigid stator; rotary cutting means positioned upstream of said eccentric worm gear pump in a sewage flow direction for reducing the size of solid materials in the sewage; a drive motor having a rotory drive shaft provided with a first shaft end, said rotary drive shaft being connected to said pump rotor and to said rotary cutting means; and universal coupling means connecting said first shaft end of said rotary drive shaft with said pump rotor.

2. Apparatus in accordance with claim 1, wherein said universal coupling means comprise a rod-like coupling element connected by means of universal joints to said first shaft end of said rotary drive shaft and said pump rotor.

3. Apparatus according to claim 1, wherein said drive motor is a submersible motor.

4. Apparatus in accordance with claim 1, wherein said eccentric worm gear pumps and said rotary cutting means are arranged at opposite sides of said drive motor and connected to opposite ends of said rotary drive shaft.

5. Apparatus in accordance with claim 4, wherein said eccentric worm gear pump has an inlet and said rotary cutting means has an outlet communication, said outlet communication being connected to said inlet by a suction pipe.

6. Apparatus in accordance with claim 5, wherein said drive motor is provided with a housing, said rotary drive shaft extending in a substantially vertical direction, said suction pipe extending substantially parallel to said rotary drive shaft and outwardly of said housing, said suction pipe providing fluid communication between said eccentric worm gear pump and said rotary cutting means.

7. Apparatus in accordance with claim 6, wherein said rotary cutting means includes a cutting head positioned at an inlet of said rotary cutting means and mounted on a second shaft end of said rotary drive shaft of said drive motor.

8. Apparatus in accordance with claim 7, wherein said rotary cutting means includes a water deflecting disc mounted on a portion of said cutting head located away from said inlet.

9. Apparatus in accordance with claim 8, wherein said water deflecting disc is adjacent to an upper edge of a lateral connecting member connected to said suction pipe.

10. Apparatus in accordance with claim 1, wherein said rotary cutting means and said eccentric worm gear pump are mounted on the same side of said drive motor.

11. Apparatus in accordance with claim 10, wherein said rotary drive shaft carries a cutting head of said rotary cutting means, and wherein said rotary drive shaft is connected at one end with the pump rotor of said eccentric worm gear pump by a rod-like coupling element, said rod-like coupling element being connected to said one end of said rotary drive shaft and said pump rotor by means of universal joints.

12. Apparatus for conveying sewage, said apparatus comprising: a housing having an inlet and an outlet; a rotating displacement pump within the housing; rotary cutting means positioned within the housing between said inlet and said outlet and upstream of the displacement pump in a sewage flow direction for reducing the size of solid materials in the sewage; the displacement pump and the cutting means connected by a common rotary drive shaft; and means for rotating said common rotary drive shaft, wherein the displacement pump is an eccentric worm-gear pump, wherein the displacement pump and the cutting means are positioned at opposite ends of said rotary drive shaft, and a suction pipe extends from an inlet of the displacement pump to an outlet communicating with the cutting means, wherein said means for rotating includes an electric motor and the displacement pump and the cutting means are on opposite sides of said electric motor, said motor having an output shaft extending in a vertical direction, said suction pipe extending substantially parallel to said output shaft and outwardly of said housing and providing fluid communication between the displacement pump and the cutting means.

* * * * *